US009840906B2

(12) United States Patent
Scheibelmasser et al.

(10) Patent No.: US 9,840,906 B2
(45) Date of Patent: Dec. 12, 2017

(54) METHOD AND DEVICE FOR SUPPLYING AT LEAST ONE ELECTRICAL CONSUMER OF A DRILL PIPE WITH AN OPERATING VOLTAGE

(71) Applicant: ADVANCED DRILLING SOLUTIONS GMBH, Leoben (AT)

(72) Inventors: Anton Scheibelmasser, Graz (AT); Bouchra Lamik-Thonhauser, Gai (AT); Franz Michael Fasch, Leoben (AT); Johann Jud, Kindberg (AT)

(73) Assignee: think and vision GmbH, Leoben (AT)

( * ) Notice: Subject to any disclaimer, the term of this patent is extended or adjusted under 35 U.S.C. 154(b) by 790 days.

(21) Appl. No.: 14/347,107

(22) PCT Filed: Sep. 26, 2012

(86) PCT No.: PCT/AT2012/000244
§ 371 (c)(1),
(2) Date: Mar. 25, 2014

(87) PCT Pub. No.: WO2013/044279
PCT Pub. Date: Apr. 4, 2013

(65) Prior Publication Data

US 2014/0224481 A1 Aug. 14, 2014

(30) Foreign Application Priority Data

Sep. 26, 2011 (AT) ..... A 1386/2011

(51) Int. Cl.
*E21B 47/12* (2012.01)
*E21B 17/00* (2006.01)
*E21B 17/02* (2006.01)

(52) U.S. Cl.
CPC ..... *E21B 47/12* (2013.01); *E21B 17/003* (2013.01); *E21B 17/023* (2013.01); *E21B 47/122* (2013.01); *E21B 47/124* (2013.01)

(58) Field of Classification Search
None
See application file for complete search history.

(56) References Cited

U.S. PATENT DOCUMENTS 2,925,251 A * 2/1960 Arps ..... E21B 47/12 116/137 R
4,176,894 A * 12/1979 Godbey ..... H01R 13/523 439/194

(Continued)

FOREIGN PATENT DOCUMENTS

AT 508 272 12/2010
DE 100 44 594 4/2002

(Continued)

OTHER PUBLICATIONS

International Search Report dated Oct. 16, 2013, corresponding to PCT/AT2012/000244.

(Continued)

*Primary Examiner* — Jermele M Hollington
*Assistant Examiner* — Suresh K Rajaputra
(74) *Attorney, Agent, or Firm* — Young & Thompson

(57) ABSTRACT

In a method and device for supplying at least one electrical consumer (10) of a drill pipe with an operating voltage, at least one electrical component (10, 11, 15) on pipe rods (6) of the drill pipe is tested for defects with a test voltage that is smaller than the operating voltage before the operating voltage is applied, and the operating voltage can only be applied when no defects are present.

19 Claims, 2 Drawing Sheets

(56) References Cited

U.S. PATENT DOCUMENTS

Figure 1:
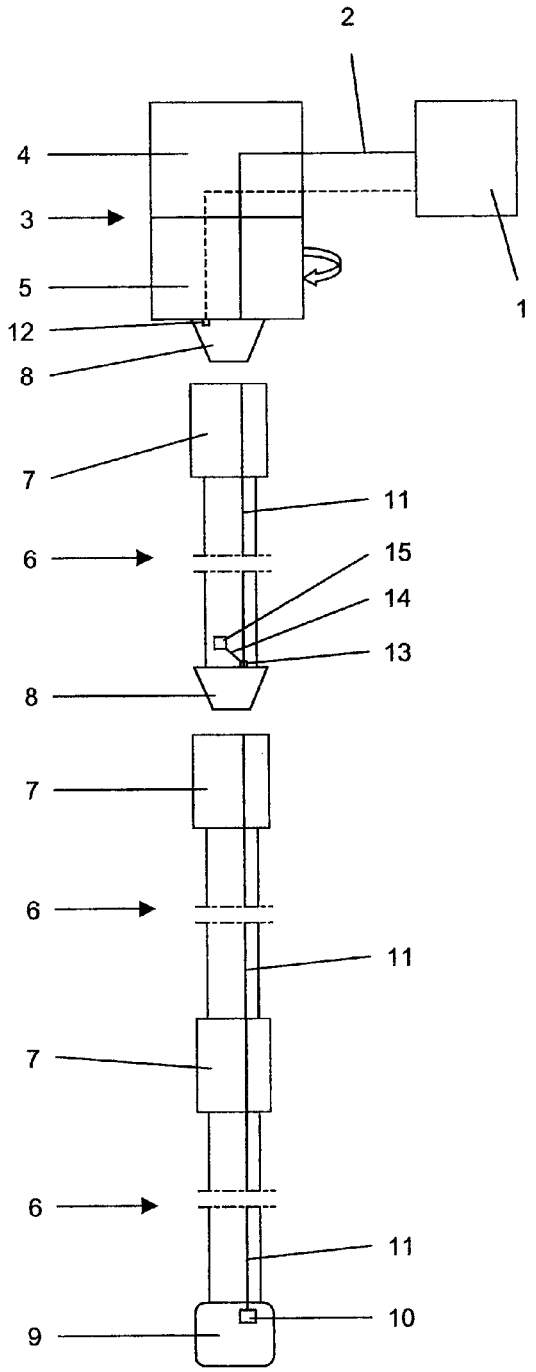

| | | | | |
|---|---|---|---|---|
| 4,269,554 | A * | 5/1981 | Jackson | E21B 19/14 294/102.2 |
| 4,963,822 | A | 10/1990 | Prokopp | |
| 6,869,289 | B2 | 3/2005 | Sabatier et al. | |
| 7,040,415 | B2 * | 5/2006 | Boyle | E21B 17/023 175/40 |
| 7,913,773 | B2 * | 3/2011 | Li | E21B 17/003 175/24 |
| 8,826,972 | B2 * | 9/2014 | Flint | E21B 17/006 166/250.11 |
| 2004/0005792 | A1 | 1/2004 | Sabatier et al. | |
| 2004/0217880 | A1 * | 11/2004 | Clark | E21B 47/12 340/854.9 |
| 2005/0046591 | A1 * | 3/2005 | Pacault | E21B 47/12 340/855.2 |
| 2008/0099197 | A1 * | 5/2008 | Payne | E21B 41/0021 166/250.01 |
| 2008/0158005 | A1 * | 7/2008 | Santoso | E21B 17/028 340/854.4 |
| 2009/0101338 | A1 * | 4/2009 | Flanders | E21B 47/0007 166/250.01 |
| 2009/0260829 | A1 * | 10/2009 | Mathis | E21B 33/0355 166/336 |
| 2009/0289808 | A1 * | 11/2009 | Prammer | E21B 17/003 340/853.7 |
| 2009/0301723 | A1 * | 12/2009 | Gray | E21B 23/00 166/301 |
| 2010/0182012 | A1 * | 7/2010 | Harmon | E21B 17/042 324/537 |

FOREIGN PATENT DOCUMENTS

| | | |
|---|---|---|
| EP | 0344654 | 12/1989 |
| FR | 2815127 | 4/2012 |
| JP | 9304432 | 11/1997 |

OTHER PUBLICATIONS

Austrian Search Report dated Mar. 28, 2012, corresponding to the Foreign Priority Application No. A 1386/2011.

* cited by examiner

METHOD AND DEVICE FOR SUPPLYING AT LEAST ONE ELECTRICAL CONSUMER OF A DRILL PIPE WITH AN OPERATING VOLTAGE

The invention relates to a method and a device for supplying at least one electrical consumer of a pipe string with an operating voltage.

One important element in modern petroleum, natural gas and geothermal wells is data acquisition during the drilling process. Only by the acquisition of the respective relevant measurement quantities can a well be reliably, efficiently and economically operated. One problem arises, however, in real-time data transmission of measurement data to the surface of the drilling rig. The data should be transmitted with a high data rate from several kilometers deep.

The drill pipes are coupled at regular distances (for example, 9 meters). In this way, a pipe string that is several kilometers long arises on whose end the drill bit is located. Within the pipes is the mud that performs functions of many kinds during the drilling process. If simple steel pipes without cabling are used at drilling installations, one of these functions is the transmission of data by means of pressure pulses. Since this communication is very slow (for example, 10 baud), methods that use other transmission mechanisms have been increasingly sought (sonar, currents via the soil, etc.).

Designs that are associated with cabling of the pipe string have proven most efficient (power cable, optical fiber, etc.). As soon as the pipe string is connected by means of electrical cables or conductive layers, high speed data transmission becomes possible. An electrically-cabled pipe string offers, on the one hand, a high bandwidth for data, but, on the other hand, also the possibility of a power supply for underground consumers, for example, underground measurement devices. Since the pipe string in this case is coupled every 9 meters, safe and reliable transmission to the rod connectors must be enabled; this can take place, for example, with a device for connection of electrical lines in drill pipes according to AT 508 272 A.

In order to be able to control the connection of electric power automatically and safely (hardware safety, operator safety, ex-safety, multifault tolerance), a system is required that connects the energy for supply of the underground consumers only if there is a connection between the drill pipes and an underground consumer and there is no danger to the drilling rig personnel.

To achieve this object, in a method of the initially-named type, the invention proposes that before applying the operating voltage, at least one electrical component on the drill pipes of the pipe string is checked for faults with a test voltage that is smaller than the operating voltage, and the operating voltage can only be applied when there are no faults.

To achieve this object, the invention furthermore proposes a device of the initially-named type that is characterized by a circuit with which alternatively a test circuit or operating circuit can be placed on at least one electrical component on drill pipes of the pipe string.

It is preferred in the invention if the test voltage is an extra-low voltage, and the operating voltage can then be, for example, a low voltage. A low voltage is defined conventionally as a nominal voltage of between 50 and 1000 V for alternating current (AC) and between 75 and 1500 V for direct current (DC). In electrical engineering, conventionally AC voltages up to 50 volts effective value and DC voltages up to 120 volts are called extra-low voltage. Within the scope of this invention, these values can, however, also be exceeded or undershot in an acceptable or possible range.

Since extra-low voltage when touched for adults is not considered life-threatening and, moreover, the formation of a spark is not possible, according to the invention first of all fault checking can be done. The circuit of the device is designed such that the operating voltage can be applied to a drill pipe or the pipe string only for positive fault checking.

In this connection, safe means that operator protection, hardware protection and ex-protection for zone 1 and the necessary detection of exceptional and fault situations are ensured. Operator protection means protection against the touching of voltage-carrying parts, protection against direct/indirect touching, for example protective separation, insulation monitoring, etc.

Hardware protection means protection against unacceptably high currents (for example, a fuse), protection of the insulation against unacceptably high temperatures and mechanical destruction, etc.

Ex-protection means the following: depending on the ex-zone, measures are instituted that prevent the formation of a spark or the spread of an explosion.

Furthermore, there can be the desire to automatically identify the coupled pipe string components in the context of the drilling process. The idea of automated detection of uncabled pipe string components has already been implemented on drilling installations (RFID, code reader). Since this data acquisition, however, is not carried out in the context of an automated coupling process, it yields only conditionally valid results. For example, recognition marks are repeatedly read outside on drill pipes by changing drilling block movements and repeatedly simulate installed drill pipes. Furthermore, the RFID transponders or optical marks can become unreadable on the outside of the drill pipe in the course of the drilling process, for example because they become dirty or are destroyed.

In one preferred further development here, the invention offers the possibility that with the application of the test voltage, an identification of a drill pipe is read out or that a drill pipe is checked and/or identified by acquisition of a resistance value.

Wireless identification is likewise possible.

The invention, for example, also makes it possible to carry out wire-connected, reliable identification by the electrical connection in each drill pipe, in addition to wireless systems. The wireless identification can thus only be carried out more in the region of the drill pipe bearing, but is no longer necessary during the mounting and drilling process on the drilling rig.

Conventionally, for a drilling process, drill pipes are held by the top-drive, screwed with one end (pipe box) on the swivel, raised and with the other end (pipe pin) supplied to the preceding drill pipe of the pipe string that is keyed on the drill table, and screwed to the table. This process is repeated again and again after the drilling of a rod length, beginning with the unscrewing of the drill pipe that is fixed on the drill table from the top drive.

If it is a cabled pipe string, according to the invention parallel to this process, a measurement and control system can monitor this process and take measurements and perform tests at the right time. The normal drilling process is neither hindered nor ruined by the system according to the invention. The goal of these measurements is to automatically enable reliable connection or separation of the power supply. In the context of this process, the components that have been screwed in can be identified (UU-ID, state, absence of faults), and the operating state of the rig can be signaled.

Other preferred configurations of the invention are the subject matter of the other dependent claims.

Other features and advantages of the invention will become apparent from the following description of one preferred embodiment of the invention with reference to the attached drawings.

Figure 2:
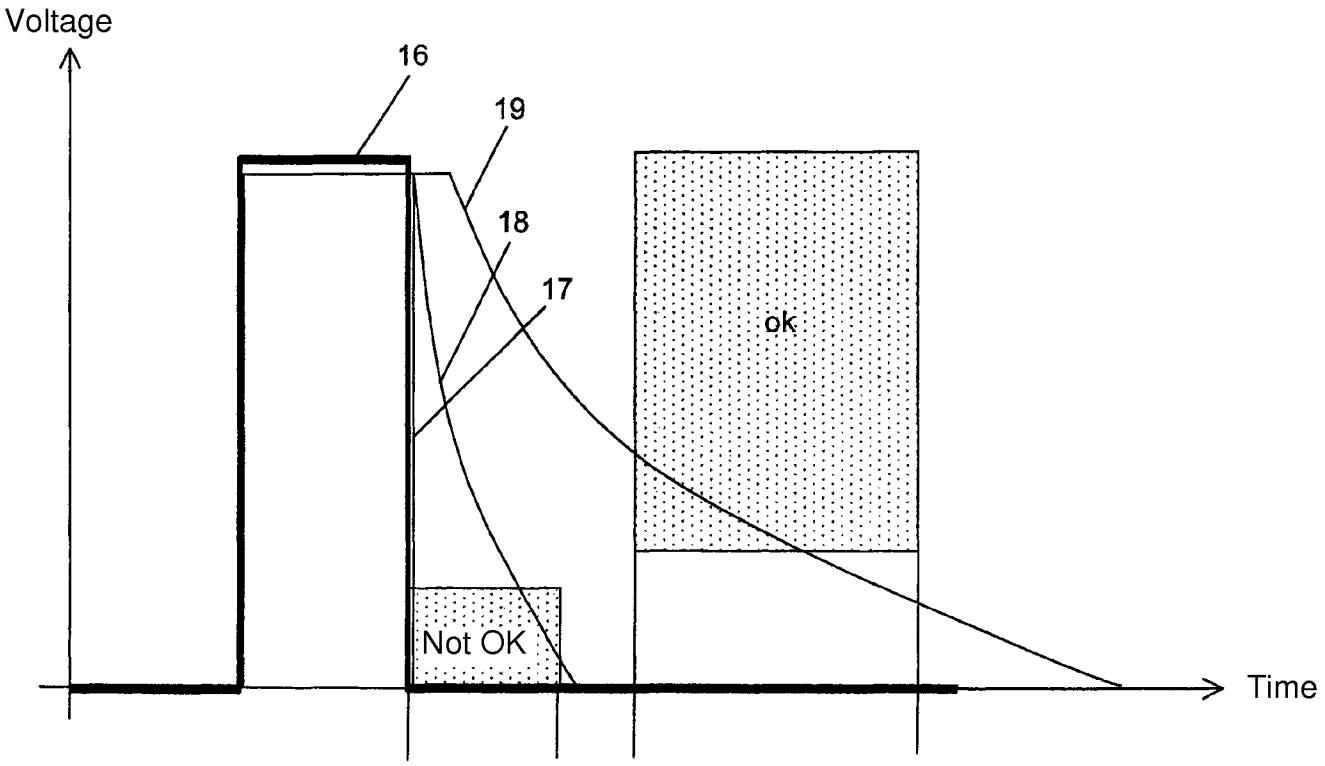

FIG. 1 shows roughly schematically a drill string according to the invention, and FIG. 2 shows a diagram with voltage characteristics as a reaction to a test signal.

One preferred embodiment of the invention, as is shown roughly schematically in FIG. 1, has an external measurement and control unit 1 that is connected via a line 2 to an electrical swivel 3 with one stationary part 4 and one rotating part 5 of a conventional drilling rig. Since, aside from the components according to the invention that are described below, the drilling rig can be built in the conventional manner, it is not shown in the drawings and is also not presented in more detail.

A drill string consists of a plurality of drill pipes 6 that are connected to one another on connectors 7, 8, conventionally screwed to one another. On the lowermost drill pipe 6, there is a drilling head 9 with at least one electrical consumer 10, for example an electronic underground measuring unit. For electrical supply of the consumer, the drill pipes 6 are equipped with electrical conductors 11 that are electrically connected to one another on the connectors 7, 8 during coupling. This mechanical and electrical connection can take place, for example, as described in AT 508 272 A.

The control unit 1 has two separate circuits that are interlocked on opposite sides for supply of the pipe string, an energy-limited (optionally intrinsically safe) test circuit with smaller test voltage, and a higher-energy, protection-separated, insulation-monitored operating circuit with a higher operating voltage. These two interlocked circuits are connected to the common cable 2 that establishes an electrical connection to the top-drive 3.

The connection/disconnection of these two interlocked circuits according to the process takes place via the control 1 that, based on sensors, detects the drilling process, measures necessary test criteria, and controls and monitors a sequence that conforms to the drilling process. In particular, there are preferably sensors for measuring the test current or test voltage as well as time measurement in a switching cabinet of the control 1.

In the rotatable part 5 of the swivel 3, there is a switch 12 that detects whether a drill pipe 6 is screwed on. Optionally, there is also an RFID reader there in order to enable wireless read-out of identification features that are stored in the RFID transponders and that can be attached on the face side to the drill pipes 6 that have been screwed on.

In each drill pipe 6 in this embodiment, there is an identification switch 13 that establishes or breaks an electrical connection 14 to an identification chip 15 or the like.

The device according to the invention and the method according to the invention operate as follows, whereby only one fault-free function is described. Deviations from this manner of operation are supplied to fault treatment and fault signaling.

The switch 12 on the swivel 3 recognizes when a drill pipe 6 has not been screwed on and signals this to the control 1. In this case, the two circuits are turned off.

When a new drill pipe 6 is being screwed onto the swivel 3, the switch 12 recognizes this, and the control 1 turns on the test circuit. The connection of the lines 2 and 11 is now closed, and the electrical signals of the wire-connected identification chip 15 can be read out and transmitted to a data processing system since the identification switch 13 is closed. This enables exact checking and documentation of the use of the individual drill pipes 6.

The invention enables a system for checking and identification (for example, by means of a UU-ID chip (universal unique identifier chip)) of drill string components in conjunction with a database. The latter stores characteristic drill pipe data (for example, length, diameter, weight, material, number, contact resistance, capacitance, inductance, surge impedance, service life data, production date, manufacturer, operating hours, maintenance interval, re-machining of the drill pipe, service interval, replacement parts). This system can therefore also optionally prevent the installation of a drill pipe that does not fit.

In addition or alternatively, the invention enables a system for checking and identifying drill string components without a database, in which one part or all relevant data are stored, for example, in addition on a UU-ID chip, and are read out during connection. The controlling software can then prevent installation depending on the data that have been read, or can check and use parameters of the drill pipe.

The wire-connected identification chip 15, for example a UU-ID chip, can be read out only at this instant since as soon as the following coupling to the last drill pipe 6 of the drill string has taken place, the identification switch 13 is opened, and in this way, the connection of the chip 15 to the line 11 is broken.

Alternatively, when the drill pipe 6 is supplied with a DC low voltage (DC voltage) the identification switch 13 in the drill pipe 6 can be replaced by a diode. In this case, the test voltage (extra-low voltage) is connected in reversed polarity like the supply voltage by the control 1 for reading out the ID of the drill pipe 6. In normal operation, the supply voltage cannot destroy the ID chip since it is protected by the diode in the reverse direction.

Alternatively or additionally, as mentioned, an RFID transponder can also be used. In order to prevent repeated read-out of the RFID transponder, it can be provided in this case that the RFID transponder after coupling is concealed in the steel of the drill pipe face and thus is protected and can no longer be read out.

In one embodiment of the invention, a fault-free drill pipe 6, uncoupled, therefore with the identification switch 13 closed, generates a short-circuit (alternatively, a certain resistance value or power consumption starting from a voltage boundary value (Zener diode), preferably an electrical pulse shape ("1-wire protocol")) that is recognized by a test current measurement/voltage measurement and sets the status of the drill pipe 6 to "valid," i.e., the control 1 recognizes a fault-free drill pipe 6. In addition, in this check, the positive acknowledgement of an optional drill pipe tracking system can be awaited (for example, drill pipe not too old, drill pipe of the correct manufacturer, drill pipe maintained, etc.).

Accordingly, the drill pipe 6 on the drill table is screwed to the drill string. In doing so, contact pins of a drill pipe 6 are connected to the sleeves of the other drill pipe 6, as is described in, for example, AT 508 272 A. Alternative electrical connections of the conductors 11 of the drill pipe 6 are, of course, also possible. Test current measurement recognizes this process, for example, in that the short-circuit is cancelled by the opening of the identification switch 13 during the coupling. In this way, a fault-free status is signaled (for example: "drill pipe fault-free, connection screwed down").

A measurement system that is located near the drill head 9 at great depth can likewise contain an ID chip and a diode that has been connected in series in order to either read it out with changing polarity or to protect it against the high supply voltage. Here, however, an interface in the measurement system must transmit the ID chip information in the form of a modulated constant current loop (current pulses) in order to bridge large distances (optionally several km). In this case, the interface is supplied from this test current loop.

In order to further increase safety, the control 1 in one preferred embodiment of the invention can generate a charging/discharging logic sequence by means of an energy-limited test voltage. In doing so, current signals (for example, rectangular pulses or constant current pulses) are applied to the drill string or its electrical components, and the reaction of the system to these test signals in the current domain or voltage domain is analyzed in time. This analysis enables differentiation of an underground consumer from a no-load operation or short-circuit or a consumer outside of the system from a valid, fault-free consumer even beyond long line lengths.

This test is based on at least one electronic underground consumer 10 that is connected to the cabled pipe string and on an equivalent electrical replacement (for example, capacitance, resistance, power consumption) that simulates the consumer for test purposes.

In the diagram from FIG. 2, the characteristic of such a test with three exemplary characteristics is shown. First of all, a rectangular test voltage pulse 16, for example between 0 V and 10 V and between 1 mA and 20 mA, is applied to the line 2 and the lines 11 that are connected to it. If there is an electrical short-circuit somewhere in the electrical path, the measured voltage immediately drops again to zero, as is shown by the line 17.

If there is, for example, an electrical contact to a human body, the voltage drops somewhat more slowly, as is shown by the line 18. For example, a time interval <400 ms and a voltage U<0.15 V can be fixed as boundary values for an unacceptably rapid drop of the voltage. In such a fault case, the test is repeated until a fault is no longer detected or a given number of tests have not been successful, whereupon it is broken off and the fault must be specifically determined.

A test is successful, for example, at a voltage characteristic along the line 19 for which the capacitance of the electrical component(s) is so great that the voltage after a time >500 ms is still >0.625 V. Such a positive test is preferably repeated, for example three times, in order to ensure a sufficient fault tolerance.

When the voltage drops too slowly, this can also be an indication of a fault so that this test is also repeated until the fault is no longer detected or a given number of tests has not been successful, whereupon the fault component is sought and examined.

The time interval within which the test voltage must drop to a given amount depends on the electrical or capacitive properties of the electrical component(s) and is taken into account in the control and in the evaluation of the tests by corresponding setpoints. This test method can, if necessary, also be used independently of the system according to the invention of a test circuit and of an operating circuit.

After a successful test and especially a recognition of a valid or fault-free underground consumer 10, the control turns off the test circuit and reliably connects the operating circuit. The pipe string or the underground consumer(s) 10 are now supplied with electric power. There is no danger of touching voltage-carrying parts or of the formation of a spark.

After the drilling process of one drill pipe length, the drill pipe is keyed on the drill table and is unscrewed from the swivel 3. The switch 12 on the swivel 3 recognizes the separation and turns off the operating circuit. If unscrewing does not take place first on the swivel 3, but rather on the drill table, the control 1 recognizes current interruption and likewise switches the operating circuit off.

The process of connecting another drill pipe to the pipe string then starts again at the beginning, as described.

The underground consumer works, for example, as a measurement system and transmits data by means of the cabled connection 11, for example by means of PLC ("powerline communication"). The control 1 permanently checks the energy supply or the successful communication by measuring the current.

The invention claimed is:

1. A method for supplying at least one electrical consumer (10) of a pipe string with an operating voltage, the pipe string being comprised of a plurality of connected drill pipes (6), the pipe string having a first end and an opposite second end with a drilling head (9), the at least one electrical consumer (10) of the pipe string being located at the second end of the pipe string, the method comprising:

before applying the operating voltage to the at least one electrical consumer (10) of the pipe string, from the first end of the pipe string, checking at least one electrical component (10, 11, 15) on the plurality of connected drill pipes (6) of the pipe string for faults with a test voltage that is smaller than the operating voltage, and applying the operating voltage only when there are no faults, wherein with application of the test voltage, an identification of a first drill pipe (6) under test, from among the plurality of connected drill pipes (6) of the pipe string, is read out.

2. The method according to claim 1, wherein another drill pipe, that is not connected to the pipe string, (6) is checked with the test voltage before the another drill pipe (6) is coupled to the pipe string and only when there are no faults on the another pipe, the another drill pipe (6) is coupled to the pipe string and the operating voltage is applied to the pipe string.

3. The method according to claim 2, wherein the another drill pipe (6) is checked and/or identified by detecting a resistance value.

4. The method according to claim 2, wherein screwing the another drill pipe (6) onto a swivel (3) of a drilling rig closes a switch (12) by which the test voltage for fault checking and/or an identification of the drill pipe (6) is applied to the electrical component (11, 15) of the another drill pipe (6).

5. The method according to claim 4, wherein an identification switch (13), via which the test voltage is on one electrical component (11, 15) for identification of the another drill pipe (6), is opened when the another drill pipe (6) is screwed to the first end of the pipe string.

6. The method according to claim 1, wherein the test voltage provides a current pulses (16).

7. The method according to claim 6, wherein, in checking the at least one electrical component (10, 11, 15) on the plurality of connected drill pipes (6) of the pipe string for faults with the test voltage, a voltage characteristic (17, 18, 19) that has been generated by the current pulses (16) is analyzed in time.

8. The method according to claim 1, wherein the identification of the another drill pipe (6) is read out wirelessly.

9. The method according to claim 2, wherein data of the another drill pipe (6) are read out of a database using the identification and are compared to setpoint data.

10. The method according to claim 2, wherein data of the another drill pipe (6) are read out from a data storage unit (15) on the another drill pipe (6) and are compared to setpoint data.

11. The method according to claim 1, wherein the test voltage is an extra-low voltage.

12. The method according to claim 1, wherein the operating voltage is a low voltage.

13. A device for supplying at least one electrical consumer (10) of a pipe string with an operating voltage, the pipe string being comprised of a plurality of connected drill pipes (6), the pipe string having a first end and an opposite second end with a drilling head (9), the at least one electrical consumer (10) of the pipe string being located at the second end of the pipe string, said device comprising:

a circuit (1), with which alternatively a test circuit or an operating circuit can be placed on at least one electrical component (10, 11, 15) on the plurality of connected drill pipes (6) of the pipe string to alternatively apply a test voltage on at least one electrical component (10, 11, 15) and an operating voltage to the at least one electrical consumer (10) of the pipe string, the test voltage being smaller than the operating voltage; and wherein, another drill pipe (6) that is not connected to the pipe string includes an identification switch (13) that when closed connects the test circuit to an electrical component (11, 15) of the another drill pipe (6), the device configured so that only when the another drill pipe (6) is not connected to the pipe string, the identification switch (13) is closed to connect the test circuit, for identification of the another drill pipe (6), to the electrical component (11, 15) of the another drill pipe (6).

14. The device according to claim 13, further comprising a switch (12) on a swivel (3) of a drilling rig that closes the electrical connection between the electrical component (10, 11, 15) and the test circuit or the operating circuit via the circuit (1).

15. The device according to claim 13, wherein the identification switch (13) in the closed state short-circuits connecting lines (11) in the another drill pipe.

16. The device according to claim 13, wherein the identification switch (13) i) in the closed state connects the circuit (1) to a data storage unit (15) in the another drill pipe, for example a data chip, and ii) in an open state separates the data storage unit (15) from the circuit (1).

17. A method for supplying at least one electrical consumer (10) of a pipe string with an operating voltage, the pipe string being comprised of a plurality of connected drill pipes (6), the pipe string having a first end and an opposite second end with a drilling head (9), the at least one electrical consumer (10) of the pipe string being located at the second end of the pipe string, the method comprising the steps of:

using a device having a control circuit (1) comprised of i) a test circuit that provides a test voltage for drill pipe identification interlocked with ii) an operating circuit that provides an operating voltage to the at least one electrical consumer (10) of the pipe string located at the second end of the pipe string, the test voltage being smaller than the operating voltage, wherein the control device is configured to alternatively place i) the test circuit on at least one electrical component (11, 15) on another drill pipe (6) that is not yet connected to the pipe string, and ii) the operating circuit on the at least one electrical component (10, 11, 15) on the plurality of connected drill pipes (6) of the pipe string to provide the operating voltage to the at least one electrical consumer (10) of the pipe string located at the second end of the pipe string, wherein, another drill pipe (6) that is not connected to the pipe string includes an identification switch (13) that when closed connects the test circuit to an electrical component (11, 15) of the another drill pipe (6), so that only when in a closed state, the identification switch (13) establishes an electrical connection (14) to the another drill pipe (6) that is not yet connected to the pipe string, to thereby connect the test circuit to the at least one electrical component (11, 15) of the another drill pipe (6); and before applying the operating voltage with the operating circuit to the pipe string, using the test circuit of the device to provide the test voltage to check the at least one electrical component on the another drill pipe (6) for faults, wherein with the application of the test voltage, an identification of the first drill pipe (6) is read out, and only when there are no detected faults, turning off the test circuit and turning on the operating circuit, and applying the operating voltage from the operating circuit to the pipe string.

18. The method of claim 17, further comprising the further step of using the read-out identification data of the another drill pipe (6) to read characteristic drill pipe data concerning the another drill pipe (6) out of a database.

19. The method of claim 17, further comprising the steps of: before the step of applying the operating voltage from the operating circuit to the pipe string, opening the identification switch (13) and connecting the another drill pipe (6) to the first end of the pipe string.

* * * * *